US006399195B1

(12) United States Patent
Naruse et al.

(10) Patent No.: US 6,399,195 B1
(45) Date of Patent: Jun. 4, 2002

(54) POLYESTER MONOFILAMENT FOR USE IN SCREEN GAUZE

(75) Inventors: Tsutomu Naruse; Hideo Ueda; Shigeki Honda, all of Hofu; Takuo Omote, Fukui; Keita Katsuma, Sabae, all of (JP)

(73) Assignees: Kanebo Ltd., Tokyo; Kanebo Gohsen Ltd., Osaka, both of (JP)

( * ) Notice: Subject to any disclaimer, the term of this patent is extended or adjusted under 35 U.S.C. 154(b) by 0 days.

(21) Appl. No.: 09/869,885

(22) PCT Filed: Nov. 26, 1999

(86) PCT No.: PCT/JP99/06635

§ 371 (c)(1),
(2), (4) Date: Aug. 30, 2001

(87) PCT Pub. No.: WO01/23086

PCT Pub. Date: Apr. 5, 2001

(30) Foreign Application Priority Data

Jan. 11, 1999 (JP) ..... 11-003908
Feb. 4, 1999 (JP) ..... 11-027125

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS 4,959,260 A * 9/1990 Tomoyasu et al. ..... 428/255
6,177,192 B1 * 1/2001 Asano et al. ..... 428/364

FOREIGN PATENT DOCUMENTS

JP 200314033 A * 11/2000

* cited by examiner

*Primary Examiner*—Newton Edwards
(74) *Attorney, Agent, or Firm*—Hogan & Hartson, L.L.P.

(57) ABSTRACT

A core-sheath composite type polyester monofilament for use in a screen gauze in which the sheath ingredient is a polyester formed by adding and copolymerizing, based on the polyester, 2 to 10% by weight of a polyalkylene oxide with a coloration degree (APHA) after heating at 175° C. for one hour of 30 or less and having a number average molecular weight of from 300 to 4000 and having a peak temperature (Tmax) of a dynamic loss tan (tan δ), at a measuring frequency of 110 Hz of from 97 to 120° C. which is lower by 10° C. or more than that for the core and the area ratio of core to sheath is within a range from 60:40 to 90:10. The polyester monofilament for use in a screen gauze is a monofilament for use in the high mesh screen gauze capable of completely preventing formation of scams during weaving, satisfactory in the gauze tension and excellent in the dimensional stability of gauze and in the adhesion to the photosensitive resin.

4 Claims, No Drawings

POLYESTER MONOFILAMENT FOR USE IN SCREEN GAUZE

TECHNICAL FIELD

This invention concerns a monofilament for use in a screen gauze. More specifically, it relates to a monofilament for use in a screen gauze suitable to precision screen printing.

BACKGROUND ART

Silk has been used for a long time generally as a woven fabric for printing screens but synthetic fiber meshes and stainless steel meshes have been used generally in recent years. Particularly, synthetic fiber meshes excellent in the recovery of elasticity and cost performance have been used preferably. Among them, polyester monofilaments have high adaptability to screens due to excellent dimensional stability and have been popularized generally.

In the field of printing such as printing for electronic circuits, requirement for high precision printing having high resolution power has recently been increased remarkably and the screen gauze has been developed in the direction of weaving fine denier filaments at high mesh. In the high mesh weaving, the frequency of contact and frictional force are increased between running filaments and blades of a reed arranged in a closed pitch, and whisker-like or powdery scams tend to be formed by the scraping of the filament surface. The thus formed scams not only contaminate the weaving machine but also results in a drawback upon precision printing if a portion of them is woven into the screen gauze.

In view of the above, various improved techniques have been proposed so far with an aim of decreasing the formation of scams. For example, a polyester mixed with amorphous or non-reactive polymer or silica gel has been proposed in Japanese Patent Laid-Open No. 23936/1983, but it involves a problem in inevitable deterioration of physical properties such as strength and elongation of the monofilament.

Further, a composite monofilament using a polyester as a core and a less scraping polymer such as nylon as a sheath was proposed in Japanese Patent Laid-Open No. 276048/1987. The monofilament can prevent formation of scams by the use of nylon but has not yet been completely satisfactory as the screen material in view of insufficiency of the dimensional stability due to high hygroscopic property of nylon and restriction for the application field of the screen due to poor chemical resistance of nylon.

This invention has an object to provide a monofilament for use in high mesh screen gauze capable of completely preventing formation of scams during weaving, which has been the drawback of such existent monofilaments for use in the screen gauze, favorable in the dimensional stability of the gauze, having satisfactory tension of gauze and also excellent adhesion to a photosensitive resin.

DISCLOSURE OF THE INVENTION

The above-described object of this invention can be attained by a core-sheath composite type polyester monofilament for use in a screen gauze, characterized in that the sheath ingredient is a polyester formed by adding and copolymerizing, based on the polyester, 2 to 10% by weight of a polyalkylene oxide with a coloration degree (APHA) of 30 or less after heating at 175° C. for one hour, having a number average molecular weight of from 300 to 4000, and having a peak temperature (Tmax of a dynamic loss tan (tan δ), at a measuring frequency of 110 Hz, of from 97 to 120° C. which is lower by 10° C. or more than that for the core and the area ratio of core to sheath is within the range from 60:40 to 90:10.

BEST MODE FOR CARRYING OUT THE INVENTION

In the following, this invention will be explained specifically.

In this invention, with an aim of printing at high resolution power and accurate level, a fine denier monofilament of 8 to 22 dTex is used for obtaining high density screen of 250 to 400 mesh (N/2.54 cm). The monofilament for use in the high density screen is required to have high strength at break, resistance to wearing by the weaving machine reed, adhesion to a photosensitive resin and ink affinity.

For the strength at break, a high value is preferred in view of the weaving property, the tension of gauze and dimensional stability of the gauze. In the screen gauze stretching step, a tensile strength at a predetermined value or more is required in view of the dimensional stability of the gauze. The tension is determined by strength (cN/dTex)×mesh. In a case of increasing the mesh by using the fine denier monofilament, the mesh value can not be so increased as to be in proportional with the reciprocal value of the dTex. Accordingly, a higher strength is required as the dTex value is smaller. In a case of 8–22 dTex monofilaments, the required strength is 4.9 cN/dTex or more, preferably, 5.7 cN/dTex or more.

The monofilament for use in the screen gauze is generally spun such that the polymer molecules are in a less oriented state and then stretched at a high factor after winding into a highly oriented state in order to obtain a high strength at break. The highly oriented stretched yarn becomes brittle in view of one aspect of the physical properties and is weakened to bending, shearing, and scraping. As a result, the degree of wearing by the reed increases in the weaving of the high mesh screen. In view of the weaving of the high mesh screen, it is an important subject for obtaining a satisfactory screen to simultaneously satisfy the two features of keeping high strength at break of filament and preventing formation of scams.

Further, an appropriate elongation at break of the monofilament obtained is preferably 15 to 30%, most preferably 20 to 25%, in view of the step passage and the quality of the screen gauze. If it is less than 15%, formation of scams increases during weaving and the tension of gauze is lowered, which is not desirable. On the other hand, if the elongation exceeds 30%, the strength at break is lowered and the dimensional stability of the gauze is also lowered, which is not desirable.

Further, the screen gauze is also required to have satisfactory adhesion to a photosensitive resin and ensure passage of ink upon printing. The adhesion to the photosensitive resin and the ink passability can be said as wettability on the side of the filament, for which good affinity between the polymer ingredient of the filament and the resin and the ink is required.

In this invention, this subject has been solved by using a core-sheath type composite filament comprising two kinds of fiber-forming polymers of different physical properties. As the kind of the polyesters for the core ingredient used in this invention may be mentioned aromatic polyesters such as polyethylene terephthalate (PET), polybutyrene terephthalate (PBT) and polyethylene nathphalate (PEN), or aliphatic polyesters such as polyethylene succinate and polycaprolactone. Among them, PET is used particularly preferably in view of the operability upon melt spinning and competitive performance regarding the manufacturing cost.

As the PET used in this invention, those polymers in a high viscosity region of from 0.60 to 0.90 of IV are preferably used in order to obtain a filament strength of 5.7 cN/dTex or more. PET having IV of 0.65 to 0.85 is used particularly preferably.

On the other hand, the polyester used for the sheath ingredient in this invention is a modified polyester formed by copolymerizing 2 to 10% by weight of a polyalkylene oxide having a number average molecular weight of 300 to 4000. In addition to the polyalkylene oxide, there are various kinds of glycolic ingredients copolymerizable with the polyester, but the polyalkylene oxide is used in this invention in view of the reactivity in polymerization and the viscosity reducing effect for the melting viscosity of the polymer.

As polyalkylene oxides may be mentioned polyethylene oxide, polypropylene oxide and a copolymer of ethylene oxide and propylene oxide, the polyethylene oxide being used preferably in this invention. As the polyalkylene oxide used in this invention, those with extremely less content of impurity that causes coloration of the polymer are used with an aim of improving the physical properties of the copolymer. Specifically, it is necessary that the degree of coloration after heating at 175° C. for one hour (APHA) is 30 or less. The copolymer of this invention using the polyalkylene oxide with less impurity is excellent in the whiteness and physical properties and the monofilament for use in the screen gauze using the polymer for the sheath is excellent, for example, in the weaving property and the adhesion to the photosensitive resin.

The molecular weight of the polyalkylene oxide should be 300 to 4000 and, more preferably, 600 to 3000 as the number average molecular weight. If the number average molecular weight is less than 300, the polymerizing reaction rate is lowered and, further, evaporation out of the polymerization system is caused due to the low boiling point and, as a result, it is difficult to control the predetermined amount of copolymerization. Further, if the number average molecular weight exceeds 4000, since the copolymerization randomness of the polymer is lowered, the weaving property of the screen gauze is deteriorated, that is, this leads to the formation of the scams.

The copolymerization amount of the polyalkylene oxide should be within the range from 2 to 10% by weight and, preferably, within the range from 3 to 7% by weight based on the polymer. If the amount of the polyalkylene oxide is 2% by weight less, when the screen gauze is manufactured by using the monofilament having the polyester obtained as the sheath, it undergoes abrasion by the reed to form scams, (white powder) and deteriorate the weaving property and also deteriorate the adhesion to the photosensitive resin which is not desirable. Further, if it exceeds 10% by weight, the polymer becomes excessively soft in the physical property to result in formation of scams during weaving and in lowering of the dimensional stability of the gauze, which is not desirable.

The polyester as the sheath ingredient in the monofilament according to this invention in which a specified polyalkylene oxide is copolymerized by a predetermined amounts has a unique physical property that the peak temperature (Tmax) of the dynamic loss tangent (tan δ) at a measuring frequency of 110 Hz is from 97 to 120° C., which is lower by 10° C. or more than that of the core being derived from the crystal structure. A polyester sheath with a Tmax of lower than 97° C. is not preferred since the filament becomes excessively soft to result in formation of scams during weaving and deterioration of the dimensional stability of the gauze. On the other hand, a sheath polyester with a Tmax in excess of 120° C. is not preferred since this also deteriorates the softness of the filament and results in formation of scams and lowering of adhesion to the photosensitive resin.

The polyester for the core and the sheath used in this invention can be obtained by known polymerization methods. For example, there are a DMT method starting from ester exchanging reaction of dimethyl terephthalate or a direct polymerization method staring from esterification under pressure of terephthalic acid in a case of polyethylene terephthalate and any of the methods may be used.

The time of adding the polyalkylene oxide may be at any stage till the polyester production reaction is completed but it is preferably added in a stage before the initial stage of the polycondensation reaction in order to keep the reaction uniform.

Further, the polyester for the core and the sheath in this invention may be blended with known additives, for example, antioxidants, light stabilizers and antistatics, as well as various kinds of particles, for example, titanium oxide, silicon oxide and calcium carbonate.

The composite monofilament according to this invention can be obtained by known composite spinning methods. While there is no particular restriction on the transversal cross sectional shape of the composite monofilament according to this invention, a circular shape is optimal. Modified cross-section yarns are not used except for special cases since they cause halation in the curing step of a photosensitive emulsion, to deteriorate the printing accuracy or make the linearity of stretched filaments incomplete by the twisting of the filaments upon stretching the gauze to sometimes deteriorate the uniformness of the mesh openings.

On the other hand, there is also no particular restriction on the shape of the core ingredient but it is preferred that the ingredient is not exposed to the surface of the filament. A simple circular shape concentrical with the sheath is optimum for the shape and the arrangement of the core in view of the dimensional stability of the screen after stretching the gauze.

Further, an optimal range exists for the core to sheath area ratio, for example, in relation with the filament strength and the resistance to abrasion by the reed upon weaving and it is necessary that the core to sheath ratio=60:40 to 90:10. More preferably, it is within the range from 70:30 to 80:20. If the ratio of the sheath ingredient is more than the range described above, the filament strength is insufficient, whereas if it is lower than the range described above, this results in frictional damage of the thin skin portion due to uneven. thickness or deteriorates the adhesion to the photosensitive resin, which is not desirable.

EXAMPLE

This invention will be explained more specifically with reference to examples. Evaluation in the examples is in accordance with the following methods.

A: Degree of Coloration (APHA)

A specimen is charged in a 50-ml colorimetric tube with a reference line to a height of the reference line. When the specimen is solid, it is melted at a temperature somewhat higher than the melting point. The colorimetric tube is immersed in an oil bath controlled at 175° C.±0.5° C. while flowing a nitrogen gas in the tube. After wiping off the oil stains of the calorimetric tube one hour after taking out it, the degree of coloration (APHA) is determined after heating by reference to the hue of various kinds of standard density solutions of potassium chloroplatinate and cobalt chloride in accordance with the standard method for APHA.

B: Peak Temperature (Tmax) of Dynamic Loss Tangent (tan δ)

Using RHEOVIBRON DDV-FF01 type dynamic viscoelasticity measuring apparatus manufactured by Orientec, a constant load at 0.03 (cN/dTex) is applied to a fiber of 3 cm length and tans at a rate of measuring rise 110 Hz and within a temperature range from −10° C. to 250° C. at a rate of temperature rise of, 10° C./min, and Tmax is determined based on the temperature curve of tan δ in α dispersion.

C: Elongation at Break

In accordance with JIS-L-1013, using an AGS-1KNG autograph tensile tester manufactured by Shimadzu Seisakusho Co., strength and elongation when a specimen is broken under elongation is determined under the condition at a specimen yarn length of 20 cm and a constant tensile speed of 20 cm/min.

D: Evaluation for Scam

Screen woven fabrics are woven by a Sluicer type weaving machine at a number of rotation of 300 rpm to determine an woven length till the instance that scam contamination on the reed increases and weaving can no more be conducted normally, and the weaving machine has to be stopped. It is evaluated as satisfactory "O" when the woven length is 500 m or more and as poor "X" when it is less than 500 m.

E: Adhesion to Photosensitive Resin

A diazo resin type photosensitive resin is coated as 0.2×0.2 mm dots, each at 0.2 mm pitch to a thickness of 20 μm on a screen gauze and optically exposed appropriately. Then, a scotch mending tape #810 is appended and the tape is peeled after rubbing for 10 reciprocation and adhesion is evaluated in accordance with the amount of resin transferred to the tape. It is judged as "OO" for no substantial resin transfer, as "O" for some transfer, and "X" for remarkable transfer to such an extent as causing practical troubles.

F: Dimensional Stability of Screen

Distortion in the printing patterns is observed by dimensional stability after printing 1000 sheets and judged as "O" for the absence of distortion and as "X" for the presence of distortion.

A polyethylene terephthalate polymer with an IV of 0.75 was used as the core ingredient and copolymerized while varying the addition amount of polyethylene oxide having an APHA after heating of 25 and a number average molecular weight of 1000. A copolyethylene terephthalate polymer with an IV of 0.65±0.01 was used as the sheath ingredient and a composite monofilament at a core:sheath composite ratio (area ratio) of 75:25 was spun in accordance with a known composite spinning method by using a spinneret having an orifice diameter ϕ of 0.35 at a spinning temperature of 295° C. and a take-up speed of 1500 m/min. The resultant not-stretched monofilament, about one day after the take-up, was stretched through a roller heater at 80° C. and a plate heater at 150° C. at a speed of 800 m/min to obtain a composite monofilament of 13.0 dTex having an elongation at break of 23±1%. Then, the monofilament was woven and finished to obtain a high mesh screen gauze of 300 mesh. Table 1 shows the results for the evaluation of physical properties of the polymers, characteristics of the monofilaments, weaving property and screen.

TABLE 1

| Experiment No. | Polyethylene oxide addition amount in sheath ingredient (wt %) | Tmax of sheath ingredient (° C.) | Strength of break (cN/dTex) | Formation of scam | Adhesion to photosensitive resin | Dimensional stability of screen gauze | Remark |
|---|---|---|---|---|---|---|---|
| 1 | 1.0 | 130 | 6.0 | X | X | O | Comp. Exam 1 |
| 2 | 2.0 | 115 | 6.0 | O | O | O | Exam 1 |
| 3 | 6.0 | 108 | 6.0 | O | OO | O | Exam 2 |
| 4 | 10.0 | 100 | 5.8 | O | OO | O | Exam 3 |
| 5 | 12.0 | 91 | 5.6 | X | O | X | Comp. Exam 2 |

In Comparative Example 1 (Experiment No. 1), the weaving property and the adhesion to photosensitive resin were poor due to insufficiency for the modification degree of the polymer. In Comparative Example 2 (Experiment No. 5), softness was excessive, scams were formed and the dimensional stability of the screen was poor due to excessive modification of the polymer. On the other hand, Examples 1 to 3 according to this invention (Experiment Nos 2–4) provided favorable evaluation for the scams, the adhesion to photosensitive resin and dimensional stability of the screen. Table 2 shows the result of evaluation for spinning, stretching and the weaving properties in the same manner as in Example 1, except for using, as the sheath ingredient, polyethylene terephthalate polymers formed by copolymerizing polyethylene oxide at a constant addition amount of polyethylene oxide at 5% by weight while varying the degree of coloration and the number average molecular weight.

TABLE 2

| Experiment No. | Polyethylene oxide in sheath, copolymer ingredient: Coloration degree | Number average molecular weight | Tmax of sheath ingredient (° C.) | Strength at break (cN/dTex) | Formation of scam | Adhesion to photosensitive resin | Dimensional stability of screen gauze | Remark |
|---|---|---|---|---|---|---|---|---|
| 6 | 10 | 1000 | 110 | 6.2 | O | O | O | Exam. 4 |
| 7 | 25 | 1000 | 110 | 6.0 | O | O | O | Exam. 5 |
| 8 | 25 | 200 | 113 | 5.9 | x | x | O | Comp. Exam. 3 |
| 9 | 25 | 6000 | 110 | 5.5 | x | O | x | Comp. Exam. 4 |
| 10 | 40 | 1000 | 110 | 5.3 | x | O | x | Comp. Exam. 5 |

Evaluation for the scams and the dimensional stability of the screen were poor in Comparative Example 3 (Experiment No. 8) and Comparative Example 4 (Experiment No. 9) using polyethylene oxide with the average molecular weight out of the range of this invention, as a result of degradation of the polymer physical property and in Comparative Example 5 (Experiment No. 10) using polyethylene oxide with degree of coloration out of the range of this invention, as a result of degradation of the polymer in coloration. On the other hand, in Examples 4, 5 according to this invention (Experiment Nos. 6, 7), evaluation was satisfactory both for the scams and the dimensional stability of the screen.

Monofilaments were spun, stretched and woven by using polyethylene terephthalate with an IV of 0.75 as the core ingredient and copolymerized polyethylene terephthalate with addition of 5% by weight of a polyethylene oxide having an APHA after heating of 25 and a number average molecular weight of 1000 while varying the core to sheath composite ratio and then evaluated. The results are shown in Table 3.

TABLE 3

| Experiment No. | Core:sheath composite ratio in filament | Tmax of sheath ingredient (° C.) | Strength at break (cN/dTex) | Formation of scam | Adhesion to photosensitive resin | Dimensional stability of screen gauze | Remark |
|---|---|---|---|---|---|---|---|
| 11 | 40:60 | 110 | 5.1 | O | O | X | Comp. Exam 5 |
| 12 | 65:35 | 110 | 5.8 | O | O | O | Exam 6 |
| 13 | 85:15 | 110 | 6.4 | O | O | O | Exam 7 |
| 14 | 95:5 | 110 | 6.5 | X | X | O | Comp. Exam 7 |

In Comparative Example 6 (Experiment No. 11), the dimensional stability of the screen was poor as a result of lowering of the gauze tensile strength due to insufficiency in the strength at break and, in Comparative Example 7 (Experiment No. 14), the sheath layer was temporarily broken to expose a core upon weaving and scams were formed as well to deteriorate the weaving property. On the other hand, in Examples 6 and 7 of this invention (Experiment Nos. 12 and 13), scams were not formed during weaving and the dimensional stability of screen was satisfactory as well.

INDUSTRIAL APPLICABILITY

Since the core-sheath type composite monofilament comprising a polyether according to this invention uses a copolyester giving excellent physical properties as the sheath ingredient and a polyester giving excellent dynamic properties such as high tensile strength of the monofilament as the core ingredient, it can dissolve the problem of formation of scams during weaving of high mesh screens which is the existed problem so far and can supply a screen gauze also excellent in the adhesion to the photosensitive resin and further excellent in the dimensional stability of the screen to provide satisfactory printing accuracy.

What is claimed is:

1. A core-sheath composite type polyester monofilament for use in a screen gauze in which the sheath ingredient is a polyester formed by adding and copolymerizing, based on the polyester, 2 to 10% by weight of a polyalkylene oxide with a coloration degree (APHA) of 30 or less after heating at 175° C. for one hour and having a number average molecular weight of from 300 to 4000, and the area ratio of core to sheath is within the range from 60:40 to 90:10.

2. A polyester monofilament for use in a screen gauze as defined in claim 1, wherein the sheath ingredient comprises a polyester having a peak temperature (Tmax) of a dynamic loss tan(δ) at a ingredient measuring frequency of 110 Hz is from 97 to 120° C., which is lower by 10° C. or more than that for the core.

3. A polyester monofilament for use in a screen gauze as defined in claim 1 or 2, in which the fineness of the single yarn is within the range of from 8 to 22 decitex (dTex).

4. A polyester monofilament for use in a screen gauze as defined in claim 1 or 2, wherein the elongation at break is from 15 to 30% and the strength at break is 5.7 cN/dTex or more.

* * * * *